United States Patent [19]

Haas

[11] 4,224,804

[45] Sep. 30, 1980

[54] HOT-WATER SUPPLY FOR SUBMARINES AND THE LIKE

[75] Inventor: Jörg Haas, Karlsruhe, Fed. Rep. of Germany

[73] Assignee: Bruker-Physik AG, Rheinstetten-Forchheim Am-Silberstreifen, Fed. Rep. of Germany

[21] Appl. No.: 2,611

[22] Filed: Jan. 11, 1979

[30] Foreign Application Priority Data

Jan. 14, 1978 [DE] Fed. Rep. of Germany ..... 2801534

[51] Int. Cl.[3] ..... F25B 27/02; B63H 25/26; F25D 23/12; B63C 11/46

[52] U.S. Cl. ..... 62/238; 62/240; 62/259; 114/315

[58] Field of Search ..... 62/238 E, 240, 259 B, 62/238 R; 114/315

[56] References Cited

U.S. PATENT DOCUMENTS

| | | | |
|---|---|---|---|
| 3,513,663 | 5/1970 | Martin, Jr. et al. | 62/238 E |
| 4,142,379 | 3/1979 | Kuklinski | 62/238 E |
| 4,168,745 | 9/1979 | Lastinger | 62/238 E |

OTHER PUBLICATIONS

Leon R. Glicksman, "Heat Pumps: Off & Running . . . Again," *Technology Review*, vol. 80:64-70, Jun./Jul. 1978.

*Primary Examiner*—Lloyd L. Ring
*Attorney, Agent, or Firm*—Pennie & Edmonds

[57] ABSTRACT

A hot-water heating system for use by submarines, divers and the like in an underwater environment includes a heating-medium circuit and a hot-water circuit. The heating-medium circuit includes an electric-motor-driven compressor in a water-tight submersible housing for compressing a heating-medium fluid. The heating-medium circuit also includes a condenser heat exchanger, a throttle valve, and an evaporator heat exchanger connected in series between a discharge outlet and a suction inlet of the compressor. The evaporator heat exchanger can make thermal contact with water surrounding the water-tight housing to absorb heat from the water and the condenser heat exchanger make thermal contact with the water in the hot water circuit to transfer heat to the water.

12 Claims, 1 Drawing Figure

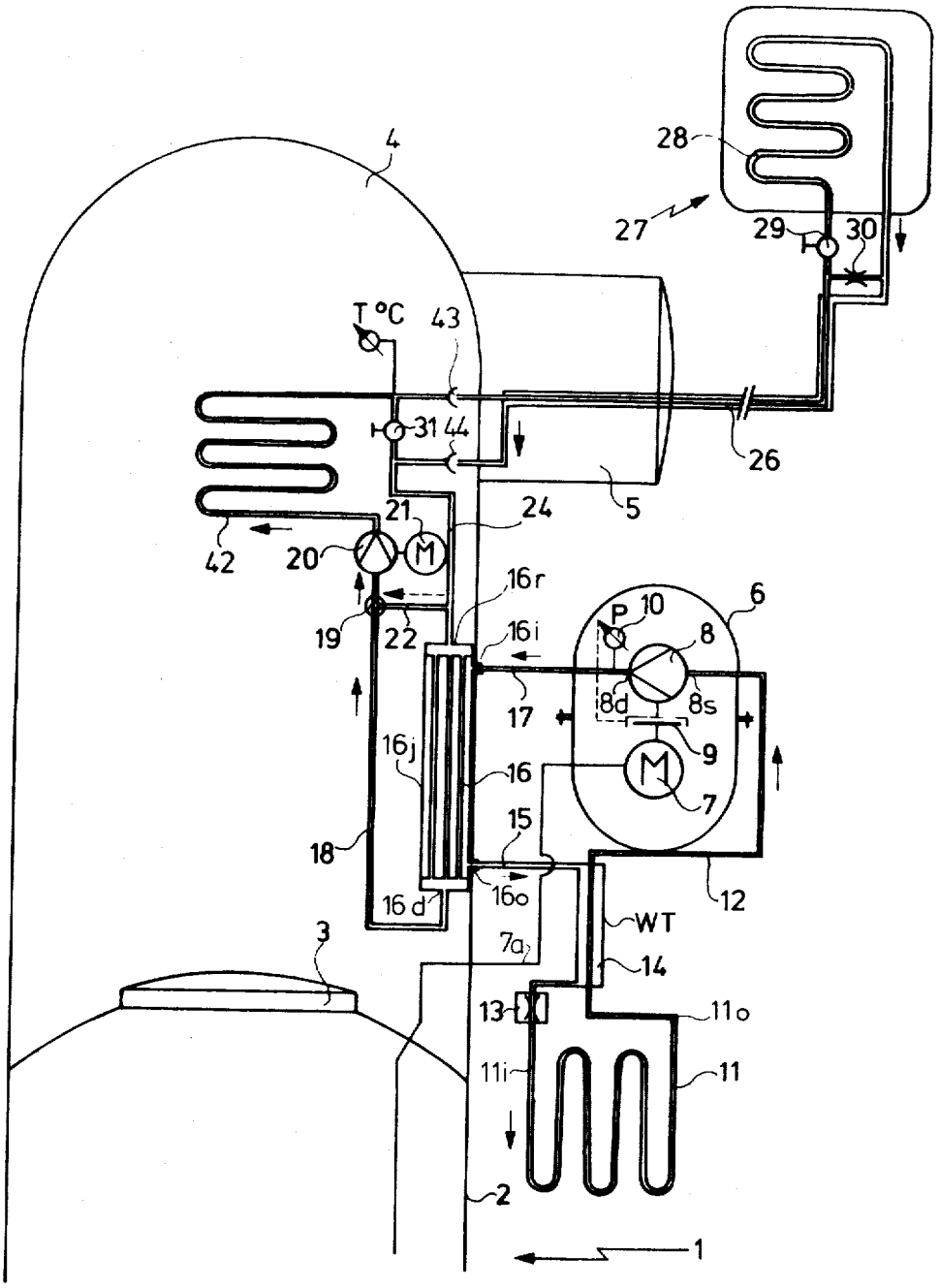
4
28
27
29
30
T °C
43
31
44
26
5
21
24
42
20
M
16r
6
P
10
8
19
22
16i
8d
8s
17
9
16j
16
M
7
15
18
16o
12
16 d
WT
3
7a
14
13
11o
11i
11
2
1

HOT-WATER SUPPLY FOR SUBMARINES AND THE LIKE

TECHNICAL FIELD

The present invention relates to a heating system for supplying hot water in an underwater environment to submarines, divers and such. For example, heated water supplied from a submarine to a diver through an umbilical line connecting the two and circulated through a thermal suit of the diver can enable the diver to work in a cold underwater environment.

BACKGROUND ART

Known water heating systems for divers working from electric-powered submarines use a closed hot-water circuit in which the water is heated by electrically-resistive heating elements. The resistive heating elements are heated by an electric current supplied from batteries carried in the submarine. A considerable portion of the total energy carried in the ship can thereby be required for heating. For example, for the heating of a diver and a water-filled diving chamber which provides the diver with an enclosed base of operation, a heat output of roughly 3.5 kW is required in water 300 m deep at a water temperature of +4° C. The ship's batteries, however, typically must also supply a propulsion plant, a working floodlight, electronic equipment, and underwater tools with energy. In typical work submarines having a diving hatch and designed to carry a crew of two, the usual charge of energy stored in the batteries is on the order of about 30 to 60 kWh, about half of which is required for propulsion and maneuvering.

The duty time of such a battery-powered submarine is limited by its store of energy. To maximize the duty time it is necessary to operate the ship as energy efficiently as possible. Nonetheless, diving chambers and divers must be adequately supplied with heat in order to obtain sufficient working time for the divers at tolerable working conditions. The problem of heating is particularly important in deep-sea diving, because deep-sea divers breath a helium-oxygen mixture and the helium portion of the respiratory mixture draws approximately seven times the amount of heat from inside the body as air does at the same temperature. This internal loss of heat together with the external loss of heat from the diver's body to the surrounding water through the thermal diving suit must be counterbalanced. The 3.5 kW heating value mentioned above is a typical value for the total internal and external heat loss of a deep-sea diver.

One of two approaches is generally adopted with respect to supplying energy for conventional resistance-heated hot-water circulation systems in present submarines adapted to support an external deep-sea diver, e.g. submarines with diving hatches and hot-water circulation systems. Generally either no provision is made for additional energy for the hot-water system, in which case the duty time of the submarine is significantly reduced, or additional energy is provided by increasing the number of storage batteries. However, increasing the number of batteries to avoid reducing the duty time requires increasing the size of the submarine significantly, thereby reducing the maneuverability of the ship. Increasing the size of the submarine also leads to an increase in the propulsive power required, which leads to a further increase in the battery capacity required. Thus serious drawbacks attend both approaches.

DISCLOSURE OF THE INVENTION

I have invented an improved water-heating system for underwater applications which vastly improves the heat yield obtained from the energy stored in batteries over resistance-heated systems now in use.

Broadly, the heating system of the invention involves a heating-medium circuit and a hot-water circuit. The heating-medium circuit includes a compressor driven by an electric motor. The compressor has a low-pressure suction input and high-pressure discharge outlet and is adapted to compress a heating-medium fluid such as difluorodichloromethane. The heating-medium circuit also includes an evaporator heat exchanger, which is connected to the suction inlet of the compressor, and a condenser heat exchanger connected to the discharge outlet of the compressor. The evaporator heat exchanger makes thermal contact with surrounding water when the heating system is in operation underwater so that the heating-medium fluid can absorb heat from the surrounding water. In operation, the condenser heat exchanger makes thermal contact with water in the hot-water circuit so that the temperature of water in the hot-water circuit can be raised by the transfer of heat from the heating-medium fluid to the water. The heating-medium circuit also includes a throttle valve connected between a heating-medium outlet of the condenser heat exchanger and a heating-medium inlet of the evaporator heat exchanger.

The heating-medium circuit functions as a heat pump. Conversion of the high-value electrical energy stored in the electric batteries into mechanical energy, which in turn serves to bring the fairly low-level heat present in practically unlimited amount in the surrounding water to a sufficiently high level for the hot-water circuit, results in substantially improved utilization of the battery energy over resistive heating.

An advantage of the invention thereby attained lies in that a heat output of 4.6 kW, for example, is obtained from only 1.8 kW electric-power output taken from the electric batteries. Because of this more efficient use of the energy stored in the batteries, the effective working time of a diver working from a submarine can be more than doubled compared to the same submarine equipped with a conventional hot water system employing resistive heaters.

Surprisingly, even with the electric motor, the compressor, the two heat exchangers, and the heat-medium fluid, the heating system of the present invention together with its energizing batteries can weigh significantly less than a conventional hot-water system of the same heating capacity, with its resistive heaters and associated batteries.

In a preferred embodiment of the invention, an additional space requirement within the submarine to accomodate the compressor and the motor is avoided by accommodating the motor-compressor unit in a separate water-tight auxiliary pressure hull located external to the pressure hull of the submarine. If desired, the electric batteries for supplying the electric motor of the heating system may also be accommodated within the auxiliary pressure hull. These batteries could also serve to supplement the batteries on board the submarine in supplying the propulsion plant of the submarine, if desired. The volume of the auxiliary pressure hull may be adjusted so that the upwardly-directed buoyant force approximately compensates for the weight of the auxiliary pressure hull and the elements accommodated therein, so that only a small upward or downward force remains. In this way, the weight of the heating system of the invention can be compensated for with at most only a minor trim of the ballast of the submarine being required in addition.

In order to match the power consumption of the motor of the heating system to the heat output required, while avoiding, insofar as possible, switching the motor on and off, the motor and the compressor are connected together by means of an electromagnetic clutch which is controlled by a pressure switch connected to the compressor discharge outlet in a preferred embodiment of the invention. When the clutch is disengaged, the compressor is stationary and the motor runs idle, its power requirement thereby being quite low. Since the pressure of the gaseous heating medium at the compressor discharge outlet is directly related to the temperature in the condenser heat exchanger as expressed by the vapor-pressure curve of the heating-medium fluid the maximum operating temperature of the condenser heat exchanger can be regulated by the pressure switch controlling the compressor by means of the electromagnetic clutch.

In a preferred embodiment of the invention, an additional heating-medium heat exchanger is employed in the heating-medium circuit. One side of this additional heating-medium heat exchanger is inserted between an inlet of the throttle valve and the heating-medium outlet of the condenser heat exchanger, and the other side is inserted between the evaporator heating-medium outlet and compressor suction inlet. This additional heating-medium heat exchanger conducts part of the heat contained in the heating-medium fluid after discharge from the condenser to the gaseous heating-medium fluid flowing to the compressor suction connection, thereby making possible a further improvement in the efficiency of the arrangement.

The condenser heat exchanger is preferably disposed within a diving chamber secured to the hull of a submarine. When the condenser heat exchanger is located in the diving chamber, it is advantageous to use the heat exchanger to supply heat directly to water in the chamber. To accomplish this, the condenser heat exchanger is preferably constructed to transfer a fraction of its heat to water in the hot-water circuit and another fraction to surrounding water in which it is immersed. Thus the preferred condenser heat exchanger can function as a heating element for the diving chamber as well as a heat source for the hotwater circuit. This has an advantage in that should circulation of hot water to the diver be interrupted, as when a pump fails, for example, the diving chamber nevertheless remains capable of being heating, because it receives heat supplied directly from the heating-medium circuit by way of the condenser heat exchanger.

Should direct heat from the condenser heat exchanger be insufficient to maintain the diving chamber at a desired temperature, a supplemental heating-element heat exchanger can be installed in the diving chamber in series with the hot-water discharge outlet of the condenser heat exchanger.

In a preferred embodiment of the invention, a mixing valve is included in the hot-water circuit to permit the temperature of the water to be regulated by by-passing the condenser heat exchanger. The mixing valve is an automatically adjustable three-way valve having a trunk port, a first branch port, and a second branch port. The first branch port is connected to the hot-water discharge outlet of the condenser heat exchanger. The second branch port is connected to a cold-water return line leading to the cold-water inlet of the condenser heat exchanger. The trunk port is connected to a heated-water supply line leading to the thermal suit of the diver. Adjustment of the mixing valve permits adjustment of the relative proportions of hot water from the first branch port and cold water from the second branch port which make up the stream flowing from the trunk port, thereby permitting the temperature of the heated water flowing to the diver to be adjusted. The adjustments are carried out automatically in response to the temperature of the water leaving the trunk port to maintain the temperature at an approximately constant value.

A hot-water circulation pump is preferably located downstream from the trunk port of the mixing valve in the heated-water supply line leading to the thermal suit of the diver. The hot water circulation pump can be powered by electricity from the main storage batteries of the submarine, if desired.

An umbilical cable leading to the thermal suit of the diver is preferably a flexible coaxial line, having an inner hose in which is carried the heated water flowing to the diver and an outer hose surrounding the inner hose to define an annular conduit in which is carried the cooled return water from the diver. This arrangement of connection is energy efficient, because the cooled return water protects the warmer water flowing to the diver from the colder surrounding water. If desired, an additional annular conduit can be provided in the coaxial line for supplying respiratory gas to the diver. The additional conduit is preferably located radially intermediate between the hoses carrying the heated and cooled water, thereby making it possible to preheat the respiratory gas and consequently reducing the internal chilling of the diver when a helium respiratory mixture used.

In a preferred embodiment of the invention a by-pass valve is connected in the hot-water circuit between the heated-water supply line and the cooled-water return line at a point in the heated-water supply line downstream from the supplemental heat exchanger for the diving chamber, but upstream of a hot-water connection to the umbilical cable, and at a point in the cold-water return line downstream from a cold-water connection to the umbilical cable, but upstream of the cold-water inlet to the condenser heat exchanger. Such a bypass valve makes it possible for a length of the hot-water circuit which includes the thermal suit of the diver to be bypassed. This feature can be useful when no one is presently making a dive and hence no thermal suit needs to be heated, but the diving chamber nonetheless requires heating. Because heat requirement is reduced in this case, the energy taken out of the batteries can be correspondingly reduced, since with reduced transfer of heat to the hot-water circuit the pressure switch in the heating-medium circuit controlling the electromagnetic clutch puts the compressor into operation less frequently and keeps it in operation for less time.

If a submarine bearing a hot-water heating system of the present invention is equipped with an electrohydraulic power plant, it is preferred to include a hydraulic-fluid heat exchanger in a hydraulic fluid tank of the submarine for cooling the hydraulic fluid in the tank and simultaneously extracting heat for the hot-water heating system. Depending on the operating temperature of the hydraulic fluid in the tank, the hydraulic-fluid heat exchanger can be in the heating-medium circuit or the hot-water circuit of the heating system.

BRIEF DESCRIPTION OF THE DRAWING

A preferred hot-water heating system of the invention is illustrated schematically in the drawing.

BEST MODE FOR CARRYING OUT THE INVENTION

Referring now to the drawing, a work submarine 1 can accommodate a crew of two, a diver and a submarine pilot. The submarine 1 has a pressure hull 2 within which the crew can be accommodated and within which a electrohydraulic propulsion plant and primary electric storage batteries are housed. The primary batteries store the energy needed to power the propulsion plant. The submarine, its power plant, and the batteries can be conventional and thus are not illustrated in the drawing.

A diving chamber 4 is attached to the pressure hull 2 and is accessible from the pressue hull 2 by way of a first hatch 3. The diving chamber 6 is provided with a second hatch 5 which provides access to the surrounding water. The diving chamber 6 can serve as a protected enclosure for a diver working outside of the submarine 1.

Secured externally to the pressure hull 2 of the submarine 1 is a smaller auxiliary pressure hull 6. Within the auxillary pressure hull 6 are mounted an electric motor 7 and a compressor 8. The compressor 8 has a high-pressure discharge outlet **8*d* and a low-pressure suction inlet 8*s*. The motor 7 is powered by electric current from the primary storage batteries of the submarine 1 which is conducted to the motor over an electric cable 7*a* which passes through sealed openings in the pressure hull 2 and the auxiliary pressure hull 6. Alternatively, as noted above, batteries for powering the motor 7 could be mounted within the auxiliary pressure hull 6** itself.

The motor 7 is connected to the compressor 8 by means of an electromagnetic clutch 9. When the clutch 9 is engaged, the motor 2 can transmit motive power to the compressor 8. When the clutch 9 is disengaged, the compressor 8 remains stationary and the motor 7 idles.

A pressure switch 10 is in communication with the high-pressure discharge outlet **8*d*, and is connected electrically to the electromagnetic clutch 9. Upon reaching a pre-selected pressure value, the switch 10 disengages the clutch 9 so that the compressor 8 becomes stationary and the motor 7** idles.

External to both the pressure hull 2 of the submarine 1 and the auxiliary pressure hull 6 is disposed an evaporator heat exchanger 11 which has a heating medium inlet **11*i* and a heating medium outlet 11*o*. When the submarine is submerged, the evaporator heat exchanger 11 contacts the surrounding water and consequently permits heat to be transferred from the surrounding water to a heating-medium fluid flowing through the heat exchanger 11**.

The heating-medium outlet **11*o* of the evaporator heat exchanger 11 is connected to the suction inlet 8*s* of the compressor 8 by means of line 12 which passes through a sealed opening of the pressure hull 6. The heating-medium inlet 11*i* of the evaporator heat exchanger 11 is connected to a low-pressure outlet of a throttle valve 13. A high-pressure inlet of the throttle valve 13 is connected to an outlet of a first side of an auxiliary heating-medium heat exchanger 14. The line 12 also passes through the heating-medium heat exchanger 14, constituting a second side of the heat exchanger. The heating-medium heat exchanger 14 permits heat to be exchanged between the low-pressure heating-medium fluid exiting the evaporator heat exchanger 11 and the high-pressure heating-medium fluid entering the throttle valve 13. A condenser heat exchanger has a heating-medium inlet 16*i*, a heating-medium outlet 16*o*, a hot-water discharge outlet 16*d*, and a cold-water return inlet 16*r*. The heating-medium inlet 16*i* is connected to the high-pressure discharge outlet 8*d* of the compressor 8 by means of a line 17 which passes through sealed openings in the wall of the diving chamber 4 and the auxiliary pressure hull 6. The heating-medium outlet 16*o* of the condenser heat exchanger 16 is connected to an inlet of the first side of the heating-medium heat exchanger 14 by means of a line 15 which passes through the wall of the diving chamber 4**.

The condenser heat exchanger 16 has an outer jacket **16*j*, the inside of which heating-medium fluid contacts as it passes between the heating-medium inlet and outlet 16*i* and 16*o*. Thus a significant fraction of the heat given up by the heating medium in the condenser heat exchanger 16 is transferred through the outer jacket 16*j* to the water within which the heat exchanger 16 is immersed. Thus the condenser heat exchanger 16 can serve as a heating element supplying heat directly to the diving chamber 4. A remaining fraction of the heat given up by the heating-medium fluid within the condenser heat exchanger 16 is transferred to water flowing between the cold-water return inlet 16*r* and the hot-water discharge outlet 16*d*** to heat the water.

From the heat-water discharge outlet **16*d* of the condenser heat exchanger 16 a heated-water supply line 18 leads to a temperature-regulating mixing valve 19. A cooled-water return line 24 is connected to the cold-water return inlet 16*r* of the condenser heat exchanger 16. The mixing valve 19 is an automatic temperature-regulating three-way valve having a trunk port, a first branch port and a second branch port. The first branch port is connected to the heated-water supply line 18. The second branch port is connected to a bypass line 22 which in turn is connected to the cooled-water return line 24. The trunk port is connected to a hot-water circulation pump 20. The temperature of the water flowing from the trunk port of the mixing valve 19 is detected and maintained at an approximately constant value by adjustments to the valve, which varies the relative fractions of hot water from the heated-water supply line 18 and cold water from the cooled-water supply line 24 combined in the mixing valve 19**.

The hot-water circulation pump 20 is driven by a motor 21, which in turn is powered by electricity from the primary storage batteries of the submarine delivered over a cable (not shown). Both the motor 21 and the pump 20 are mounted within a water-tight housing to permit their operation under water.

An inlet to a supplemental heating-element heat exchanger 42 is connected to a discharge outlet of the hot-water circulation pump 20. The supplemental heating-element heat exchanger 42 can transfer heat from the heated water flowing through it to the water within which it is immersed. Consequently, the supplemental heating-element heat exchanger 42 supplies heat to the diving chamber 4 in which it is located to supplement the heat supplied through the outer jacket 16j of the condenser heat exchanger 16.

An outlet of the supplemental heating-element heat exchanger 42 is connected to a hot-water plug connection 43 mounted in the diving chamber 4. A cold-water plug connection 44 is mounted close by the hot-water plug connection 43 and is connected to the cooled-water return line 24. As described below, a thermal suit 27 of a diver can be connected to the two plug connections 43 and 44 by an umbilical cable 26. A bypass valve 31 is connected between the hot-water plug connection 43 and the cold-water plug connection 44 on the diving chamber side of the two plug connections, i.e., on the upstream side of the hot-water plug connection 43 and the downstream side of the cold-water plug connection 44. The bypass valve 31 can be opened to bypass the two plug connections 43 and 44. Consequently, the diving chamber 4 can be heated by the supplemental heating-element heat exchanger 42 even though no thermal suit is connected to the two plug connection 43 and 44.

A flexible umbilical cable 26 is detachably connected to the two plug connections 43 and 44. The umbilical cable 26 includes a first, a second, and a third hose extending generally coaxially one inside the other. For simplicity, only two hoses are illustrated in the drawing. The first hose defines a conduit for carrying the heated water and thus is connected to the hot-water plug connection 43. The second hose surrounds the first hose to define a first annular conduit radially inward of the second hose and radially outward of the first hose. The third hose surrounds the second hose and serves as the outer casing of the umbilical cable 26. A second annular conduit is defined radially outward of the second hose and radially inward of the third hose. In operation, respiratory gas flows to the diver in the first annular conduit and cooled water flows back to the diving chamber in the second annular conduit. The second annular conduit is thus connected to the cold-water plug connection 44. As explained above, such a coaxial arrangement reduces the heat loss from the heated water flowing in the innermost conduit and additionally warms the respiratory gas flowing to the diver. In addition to the three hoses, the umbilical cable includes electric signal lines (not shown) for communication between the diver and the crew on board the submarine.

The umbilical cable 26 is connected to a thermal suit 27 for a diver. The thermal suit 27 is provided with a heating tube 28 for warming the diver. An inlet to the heating tube 28 is connected to the innermost conduit of the umbilical cable 26 by way of a hot-water control valve 29. The diver can adjust the rate of flow of hot water in the heat tube 28 by adjusting the control valve 29 to maintain the temperature in the thermal suit 27 at a comfortable level. An internal bypass valve 30 mounted on the thermal suit 27 maintains a sufficient flow of heated water through the umbilical cable 26 when the flow through the heat tube 28 is reduced to prevent the heated water from cooling excessively as it passes through the umbilical cable 26.

In operation, the compressor 8 compresses the gaseous heating medium to about 18 bars and discharges it into the condenser heat exchanger 16. Difluorodichloromethane is a preferred heating medium fluid. The temperature of the compressed gas, which depends upon the pressure and type of gas, is on the order of about 70° C. in the system described. The water for the hot-water circuit is heated in the condenser heat exchanger 16 to about 65° C., while some of the heating medium condenses to a liquid. By way of the line 15 it flows to the heating-medium heat exchanger 14, where it is further cooled, and from where it goes to the throttle valve 13. In expanding through the throttle valve 13, difluorodichloromethane cools to about −15° C. The surrounding water is typically at least 4° to 6° C. and thus heats the gaseous heating medium in the evaporator heat exchanger 11 from −15° C. to about 0° to 4° C. The heating medium subsequently flows through the heating-medium heat exchanger 14 from which it leaves at a temperature of about +10° C. From the outlet of the heating medium heat exchanger 14, the heating medium is directed to the suction inlet 8s of the compressor 8. The compressor 8 compresses the heating medium again to about 18 bars at 70° to 75° C., completing a cycle.

The heating medium circuit and the hot-water circuit have the condenser heat exchanger 16 as a common heat exchanger. As mentioned above, in this condenser water is heated to about 65° C. and is circulated by the hot-water circulation pump 20 installed inside the diving chamber 4. The temperature regulating valve 19 maintains the temperature of the hot water flowing to the heating element heat exchanger 42 within about ±2° C. (Without the temperature regulator 19 the temperature could fluctuate by about ±4° C.) The hot water flows from the heating-element heat exchanger 42 by way of the hot-water plug connection 43 through the innermost conduit of the umbilical cable 26 to the thermal suit 27 where it is available to warm the diver. Cooled water from the thermal suit 27 flows into the second annular conduit of the umbilical cable 26 back to the cold-water plug connection 24 and subsequently to the cooled-water return inlet of the condenser heat exchanger 16.

The switching points of the pressure switch 10 are preferably selected such that on reaching a temperature of about 75° C. the electromagnetic clutch 9 is disengaged and on reaching a temperature of about 55° C. the electromagnetic clutch 9 is engaged. The temperature of the water at the inlet to the thermal suit 27 is preferably about 35° C.±2° C., and the temperature of the water at the outlet of the thermal suit 27 is preferably about 25° C. At a flow-through rate of about 1 l/min., the heat given off to the diver is preferably about 480 W, and at a through-flow rate of 3 l/min is preferably about 1460 W, which, according to experience, is entirely adequate.

It is not intended to limit the present invention to the specific embodiment described above. For example, the heating system of the invention is not limited to work submarines, but may be used generally in underwater vehicles and apparatus such as manned and unmanned underwater laboratories, diving bells, underwater work chambers and other work equipment, and in individual heating systems for divers. It is recognized that these and other changes may be made in the apparatus specifically described herein without departing from the scope and teachings of the instant invention, and it is intended to encompass all other embodiments, alternatives and modifications consistent with the present invention.

I claim:

1. A heating system supplying heated water in an underwater environment, the heating system comprising:

(a) a water-tight submersible housing;

(b) an electric motor located within the submersible housing;

(c) conductive means for connecting the motor to electric storage batteries to transmit electric power to the motor;

(d) a compressor located within the submersible housing, the compressor having a low-pressure suction inlet and a high-pressure discharge outlet, the compressor being adapted to compress a heating-medium fluid;

(e) drive coupling means connected between the motor and the compressor for transmitting motive power from the motor to the compressor;

(f) an evaporator heat exchanger having a heating-medium inlet and a heating-medium outlet, the heating-medium outlet being connected to the suction inlet of the compressor, the submersible housing having at least one sealed port opening permitting the evaporator heat exchanger to communicate with surrounding water outside of the housing so that the heat exchanger makes thermal contact with the surrounding water to absorb heat from the water when the submersible housing is submerged;

(g) a throttle valve having a high-pressure inlet and a low-pressure outlet, the low pressure outlet being connected to the heating-medium inlet of the evaporator heat exchanger; and (h) a condenser heat exchanger, the condenser heat exchanger having a heating-medium inlet and a heating-medium outlet, the heating-medium inlet being connected to the discharge outlet of the compressor and the heating-medium outlet being connected to the high-pressure inlet of the throttle valve, the condenser heat exchanger further having a cooled-water return inlet and a heated-water discharge outlet so that water can be caused to flow through the heat exchanger to absorb heat from a heating-medium fluid passing through the heat exchanger.

2. The heating system according to claim 1 in which the water-tight submersible housing is a pressure hull of a submarine, the submarine being capable of accommodating at least one crew member and being powered by primary electric storage batteries, and in which the conductive means comprises an electric cable for connecting the motor to the primary electric storage batteries.

3. The heating system according to claim 1 in which the water-tight housing is an unmanned pressure hull.

4. The heating system according to either claim 2 or claim 3 further comprising:

(i) a pressure switch in communication with high-pressure discharge outlet of the compressor for generating a first electric signal when the pressure at the discharge outlet exceeds a first predetermined value and a second electric signal when the pressure falls below a second predetermined value; and in which (e.i.) the drive coupling means includes an electromagnetic clutch connected to the pressure switch for disengaging and engaging the drive coupling between the motor and the compressor in response to the first and the second electric signals respectively.

5. The heating system according to claim 4 further comprising:

(j) a heating-medium heat exchanger having a first side and a second side through which a heating-medium fluid may flow, the first side being connected between the heating-medium outlet of the evaporator heat exchanger and the suction inlet of the compressor, and the second side being connected between the heating-medium outlet of the condenser heat exchanger and the high-pressure inlet of the throttle valve.

6. The heating system according to claim 5 in which the condenser heat exchanger is external to the water-tight housing in a diving chamber, the condenser heat exchanger being adapted to transfer a first portion of heat to surrounding water in the diving chamber in which it is immersed and a second portion of heat to water flowing between the cooled-water return inlet and heated-water discharged outlet.

7. The heating system according to claim 6 further comprising:

(k) a temperature-regulating mixing valve for maintaining the temperature of the hot water at a preselected value, the temperature-regulating mixing valve having a trunk output, a first branch input, and a second branch input, the trunk output defining a regulated-temperature hot-water supply outlet, the first branch inlet being connected to the heated-water discharge outlet of the condenser heat exchanger, and the second branch inlet being connected as a bypass for the cooled-water return inlet of the condenser heat exchanger, the temperature-regulating mixing valve being adapted to adjust the relative proportions of hot and cold water mixed in the valve to regulate the temperature of the water supplied at the trunk port.

8. The heating system according to claim 7 further comprising:

(l) a heating-element heat exchanger connected to the trunk port of the temperature-regulating mixing valve, the heating-element heat exchanger being located in the diving chamber and being adapted to transfer heat from hot water flowing through the heat exchanger to surrounding water in which the heat exchanger is immersed.

9. The heating system according to claim 8 further comprising:

(m) a bypass valve connected between an outlet of the heating-element heat exchanger and the cooled-water return inlet of the condenser heat exchanger.

10. The heating system according to claim 9 further comprising:

(n) an umbilical cable for connecting a water-heated thermal suit to the system, the umbilical cable including a first flexible hose and a second flexible hose surrounding and extending generally coaxially with the first hose, the interior of the first hose defining heated-water conduit for supplying heated water to the thermal suit, the heated-water conduit being in communication with an outlet of the heating-element heat exchanger, an annular space radially inward of the second hose and radially outward of the first hose defining a cooled-water conduit for returning cooled water from the thermal suit, the cooled water conduit being in communication with the cooled-water return inlet of the condenser heat exchanger.

11. The heating system according to claim 10, in which the umbilical cable further includes an intermediate flexible hose disposed radially intermediate between the first hose and the second hose and extending generally coaxially with the first and second hose, an annular space radially inward of the second hose and radially outward of the intermediate hose defining the cooled-water conduit, and an annular space radially inward of the intermediate hose and radially outward of the first hose defining a respiratory-gas conduit for supplying a respiratory gas to a diver.

12. The heating system according to claim 2 in which the submarine has an electrohydraulic power plant having a hydraulic fluid tank, the heating system further comprising a hydraulic-fluid heat exchanger disposed within the hydraulic fluid tank and communicating with the heating system for transferring heat from hydraulic fluid in the tank to the heating system.

* * * * *